US012128474B2

(12) United States Patent
Yang et al.

(10) Patent No.: US 12,128,474 B2
(45) Date of Patent: Oct. 29, 2024

(54) METHOD FOR PREPARING NEGATIVE PRESSURE FILM-COVERING FROZEN SAND MOLD

(71) Applicant: NANJING UNIVERSITY OF AERONAUTICS AND ASTRONAUTICS, Nanjing (CN)

(72) Inventors: Haoqin Yang, Nanjing (CN); Zhongde Shan, Nanjing (CN); Qinjiang Liu, Nanjing (CN); Jianpei Shi, Nanjing (CN); Dandan Yan, Nanjing (CN); Shijie Dong, Nanjing (CN)

(73) Assignee: NANJING UNIVERSITY OF AERONAUTICS AND ASTRONAUTICS, Nanjing (CN)

( * ) Notice: Subject to any disclaimer, the term of this patent is extended or adjusted under 35 U.S.C. 154(b) by 0 days.

(21) Appl. No.: 18/037,783

(22) PCT Filed: Sep. 5, 2022

(86) PCT No.: PCT/CN2022/117063

§ 371 (c)(1),
(2) Date: May 19, 2023

(87) PCT Pub. No.: WO2023/221341

PCT Pub. Date: Nov. 23, 2023

(65) Prior Publication Data

US 2023/0398601 A1 Dec. 14, 2023

(30) Foreign Application Priority Data

May 17, 2022 (CN) ..... 202210533241.7

(51) Int. Cl.
*B22C 9/12* (2006.01)
*B22C 9/03* (2006.01)

(52) U.S. Cl.
CPC ..... *B22C 9/126* (2013.01); *B22C 9/03* (2013.01)

(58) Field of Classification Search
CPC ..... B22C 9/03; B22C 9/126; B22C 3/00
See application file for complete search history.

(56) References Cited

U.S. PATENT DOCUMENTS 4,157,109 A * 6/1979 Toyoda ..... B22C 9/03 164/7.2
4,199,641 A * 4/1980 Aono ..... B22C 3/00 106/38.22
2007/0209771 A1* 9/2007 Makino ..... B22D 18/04 164/7.2

FOREIGN PATENT DOCUMENTS

CN 101823122 A 9/2010
CN 103658525 A * 3/2014
(Continued)

OTHER PUBLICATIONS

Machine Translation of Shan et al (CN 105665637A, published Jun. 15, 2016, cited in IDS filed Jun. 2, 2023). (Year: 2016).*
(Continued)

*Primary Examiner* — Kevin E Yoon
*Assistant Examiner* — Jacky Yuen
(74) *Attorney, Agent, or Firm* — Bayramoglu Law Offices LLC

(57) ABSTRACT

A method for preparing a negative pressure film-covering frozen sand mold includes: directly obtaining a mold cavity of a sand mold through numerically controlled machining of a frozen sand blank; covering a surface, brushed with a thermal insulation coating, of the mold cavity of the sand mold with a softened thin film, and covering an outer surface of the sand mold with a back film to seal a sand box; fixing the frozen sand mold in an air extraction sand box with a vacuum chamber, and extracting air through a vacuum
(Continued)

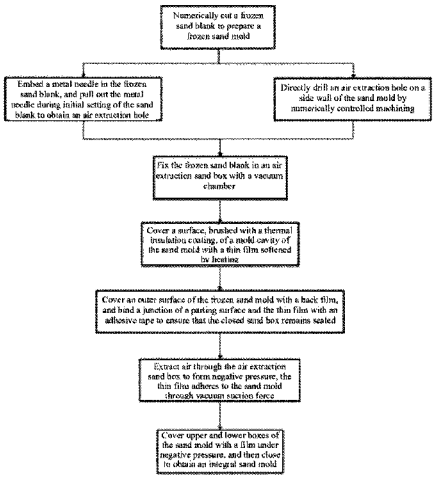

pump, so that the thin film tightly adheres to the sand mold through vacuum suction force; and closing the box to obtain an integral sand mold, and pouring a casting at room temperature or low temperature under negative pressure. The method is environment-friendly, and the prepared frozen sand mold has high strength and is convenient for sand cleaning.

7 Claims, 1 Drawing Sheet

(56) References Cited

FOREIGN PATENT DOCUMENTS

| | | | | | |
|---|---|---|---|---|---|
| CN | 104399882 | A | | 3/2015 | |
| CN | 104439066 | A | * | 3/2015 | ..... B22C 9/03 |
| CN | 104707952 | A | * | 6/2015 | |
| CN | 105665637 | A | | 6/2016 | |
| CN | 110102713 | A | | 8/2019 | |
| CN | 113579161 | A | | 11/2021 | |
| CN | 114472804 | A | | 5/2022 | |
| CN | 114888265 | A | | 8/2022 | |
| JP | 58000349 | A | * | 1/1983 | ..... B22C 9/126 |
| JP | 2012040569 | A | | 3/2012 | |

OTHER PUBLICATIONS

Machine Translation of Hou et al (CN 101823122A, published Sep. 8, 2010, cited in IDS filed Jun. 2, 2023). (Year: 2010).*

* cited by examiner

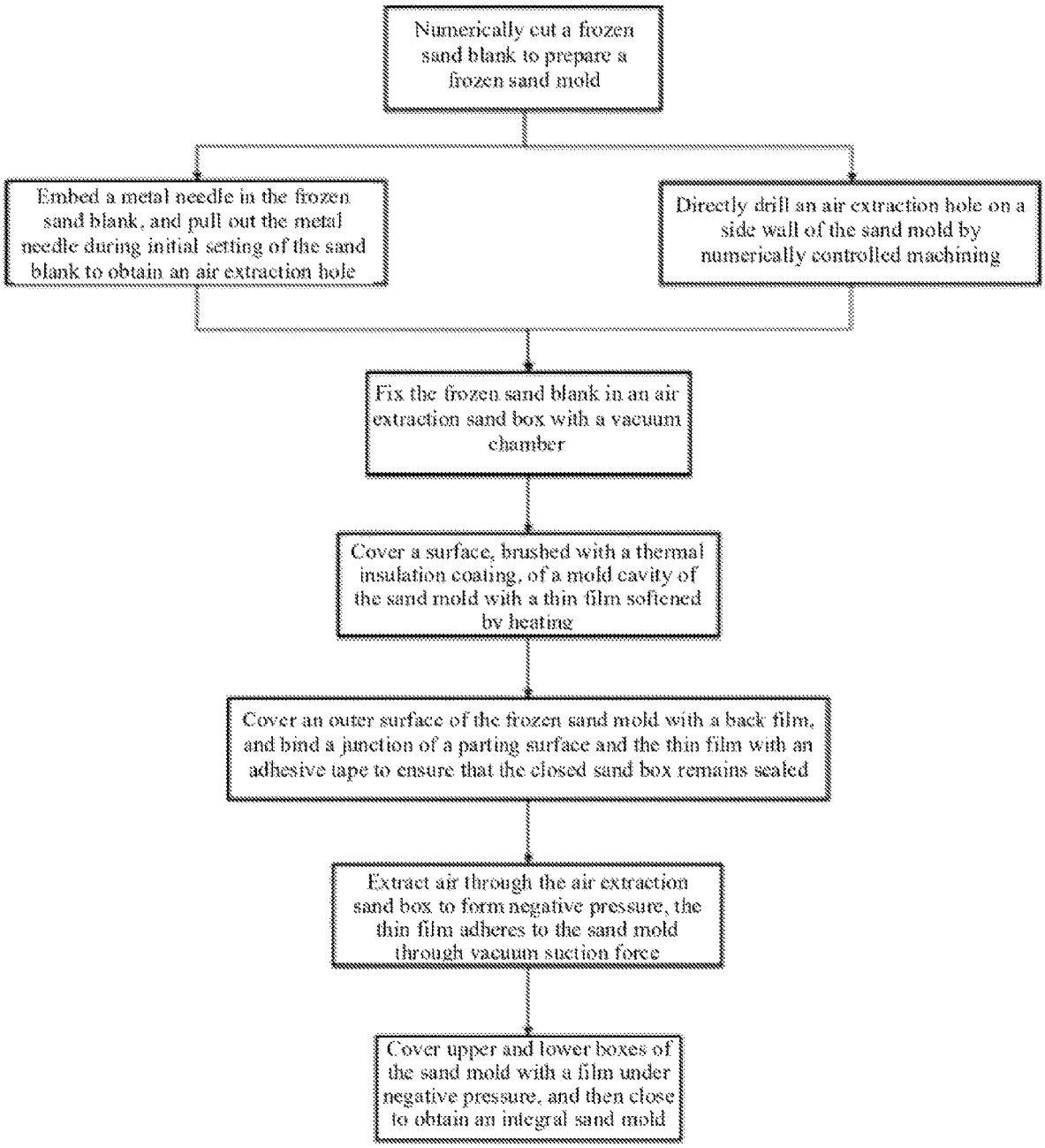
Numerically cut a frozen sand blank to prepare a frozen sand mold
Embed a metal needle in the frozen sand blank, and pull out the metal needle during initial setting of the sand blank to obtain an air extraction hole
Directly drill an air extraction hole on a side wall of the sand mold by numerically controlled machining
Fix the frozen sand blank in an air extraction sand box with a vacuum chamber
Cover a surface, brushed with a thermal insulation coating, of a mold cavity of the sand mold with a thin film softened by heating
Cover an outer surface of the frozen sand mold with a back film, and bind a junction of a parting surface and the thin film with an adhesive tape to ensure that the closed sand box remains sealed
Extract air through the air extraction sand box to form negative pressure, the thin film adheres to the sand mold through vacuum suction force
Cover upper and lower boxes of the sand mold with a film under negative pressure, and then close to obtain an integral sand mold

METHOD FOR PREPARING NEGATIVE PRESSURE FILM-COVERING FROZEN SAND MOLD

CROSS REFERENCE TO THE RELATED APPLICATIONS

This application is the national phase entry of International Application No. PCT/CN2022/117063, filed on Sep. 5, 2022, which is based upon and claims priority to Chinese Patent Application No. 202210533241.7, filed on May 17, 2022, the entire contents of which are incorporated herein by reference.

TECHNICAL FIELD

The present invention relates to the field of frozen sand mold manufacturing technology, in particular to a method for preparing a negative pressure film-covering frozen sand mold.

BACKGROUND

The conventional casting industry consumes a lot of energy and resources, is long in casting manufacturing cycle for wooden/metal mold rollover, and has problems such as many production processes, high labor intensity, expensive product development, and harsh working environment.

The conventional casting industry urgently needs breakthroughs and reforms in green processes to promote energy conservation, emission reduction, and green sustainable development in the manufacturing industry.

Frozen sand molds for casting are a new type of molds casted from water as a binder and various sand particles as refractory aggregates. After a frozen sand blank is prepared through water freezing in a low-temperature environment, the frozen sand mold is rapidly prototyped through a numerical model-free casting technology based on a cutting shaping principle.

However, in a pouring process, if the temperature of molten metal is too high, a large amount of water in the frozen sand mold is evaporated. As a result, the strength of the sand mold decreases, and the mold cavity is prone to deformation, which are not conducive to filling the mold with the molten metal. Moreover, the surface of the cavity of the frozen sand mold is directly in contact with the high-temperature molten metal, and water vapor generated instantly forms bubbles in the molten metal, so that the surface quality of a casting is damaged, the mechanical properties of the casting are affected, and even the frozen sand mold collapses prematurely in the pouring process. Therefore, a new direction needs to be broken through in the green casting industry in order to make up for the shortcoming of easy collapse of the frozen sand mold in the pouring process, ensure that the high-temperature molten metal is smoothly filled in the cavity of the frozen sand mold, prevent the phenomenon of "one-touch scattering" in the pouring process, and enable the casting to be clear in contour, accurate in size, and low in machining allowance.

SUMMARY

To solve the above problems, the present invention provides a method for preparing a negative pressure film-covering frozen sand mold, which makes up for the shortcoming of easy collapse of a frozen sand mold in a pouring process and prevents the generation of a large amount of water vapor in the pouring process. Moreover, a side wall of the sand mold is reserved with an air extraction hole for continuous vacuum extraction in molding and pouring processes, so that water vapor in the frozen sand mold can be quickly discharged to reduce the defects of air holes and pinholes in a casting. It is a new direction that needs to be broken through in the green casting industry.

A method for preparing a negative pressure film-covering frozen sand mold includes the following steps:

- step 1: numerically cutting a frozen sand blank mixed with an appropriate amount of water in a low-temperature machining environment through a numerical model-free freeze casting technology based on a cutting shaping principle to prepare a frozen sand mold;
- step 2: fixing the prepared frozen sand mold in an air extraction sand box that matches the sand mold in size, and brushing a surface of a mold cavity with a layer of thermal insulation coating;
- step 3: heating a thin film until softened to cover the surface of the mold cavity of the sand mold brushed with the thermal insulation coating;
- step 4: covering an outer surface of the sand mold with a back film to seal the sand box; and
- step 5: starting a vacuum pump to provide vacuum suction force, so that the thin film tightly adheres to the sand mold; covering upper and lower boxes of the sand mold with a film under negative pressure, and then closing the upper and lower boxes to obtain an integral sand mold.

Further, the frozen sand mold is provided with an air extraction hole, which is prepared by embedding a metal needle in the frozen sand blank and pulling out the metal needle during initial setting of the sand blank; or an air extraction hole is directly machined out on the frozen sand blank by using a numerically controlled drilling technology.

Further, a sand box for the sand mold is the air extraction sand box with a vacuum chamber, and the vacuum pump cooperates with the air extraction hole and a filtering extraction pipe to extract air.

Further, the thermal insulation coating is a barrier type thermal insulation coating, a main material of which is aerogel or the like.

Further, a vacuum degree may be controlled at 0.03-0.04 MPa in the film covering and pressure maintaining processes.

Further, the upper and lower boxes are closed to form the integral sand mold with a casting head and the mold cavity, the sand mold is maintained in a negative pressure state (a vacuum degree of 0.05-0.06 MPa and a large air extraction amount) during direct pouring at room temperature or low temperature, and gases such as water vapor generated during pouring are promptly extracted away through the air extraction hole.

Further, the thin film is one of an ethylene-vinyl acetate copolymer (EVA) plastic film, a low density polyethylene (LDPE) film, and polyester amine fibers.

Further, the thin film is heated by a heater for softening at about 70° C. and then spread on the mold cavity of the sand mold.

Further, a junction of a parting surface and the thin film is bound with an adhesive tape to prevent defects such as sand inclusion caused by falling sand.

Further, the thermal insulation coating brushed in this method can protect the surface of the mold cavity of the frozen sand mold from being damaged by the high-temperature thin film, and can also bind the film to better adhere to the surface of the mold cavity in the early stage of film covering; and during pouring, the frozen sand mold maintain its shape mainly by means of a transitional shell formed on the sand mold by residues after film vaporization.

Preferably, the coating is replaced with special sand (such as brown fused alumina). The sand mold obtained from 100/200 mesh brown fused alumina sand has higher hardness than that from 70-100 mesh ordinary sand, and the brown fused alumina sand increases refractoriness of the sand mold.

Preferably, when an upper mold is made, the periphery of the casting head is brushed with a little coating to reduce erosion of molten metal on the sand mold and sand sticking defects.

Beneficial effects of the present invention are as follows:

1. In the pouring process, the thin film instantly blocks direct contact between the high-temperature molten metal and the surface of the mold cavity of the frozen sand mold, and the residues after film vaporization form a transitional shell on the sand mold to maintain the shape. Meanwhile, the negative pressure pouring accelerates filling of the molten metal, and the molten metal quickly solidifies on the surface of the mold cavity to form a layer of metal shell with certain strength, so as to improve the density, dimensional accuracy, and the like of a casting.
2. Because the thin film blocks direct contact between the high-temperature molten metal and an ice crystal bonding bridge in the frozen sand mold, the strength of the sand mold is protected, and the generation of a large amount of water vapor in the pouring process is prevented. Moreover, the side wall of the sand mold is reserved with the air extraction hole for continuous vacuum extraction in the molding and pouring processes, so that water vapor in the frozen sand mold can be quickly discharged to reduce the defects of air holes and pinholes in the casting.

BRIEF DESCRIPTION OF THE DRAWINGS

FIGURE is a process flow diagram of the present invention.

DETAILED DESCRIPTION OF THE EMBODIMENTS

The present invention will be further illustrated below with reference to the accompanying drawing and specific embodiments. It should be understood that the following specific embodiments are merely used to explain the present invention and not to limit the scope of the present invention. It should be noted that the terms "front", "back", "left", "right", "up", and "down" used in the following description refer to directions in the drawings, and the terms "inside" and "outside" refer to directions towards or away from a geometric center of a specific component respectively.

FIGURE shows a method for preparing a negative pressure film-covering frozen sand mold in this embodiment. A frozen sand blank is numerically machined to obtain upper and lower boxes of a sand mold, the sand mold is brushed with a thermal insulation coating and then covered with a thin film, air is extracted through an air extraction box, a mold cavity and an outer surface of the sand mold are covered with a thin film and a back film separately, the upper and lower boxes are closed to form an integral sand mold with a casting head, the mold cavity, and an air extraction hole, and direct pouring is performed at room temperature or low temperature while the sand mold is maintained in a negative pressure state.

Specifically, the method includes the following steps:

Step 1: Numerically cut a frozen sand blank mixed with an appropriate amount of water directly in a low-temperature machining environment through a numerical model-free freeze casting technology based on a cutting shaping principle to prepare a frozen sand mold. In this embodiment, 100 mesh brown fused alumina is selected, the frozen sand blank contains 4% of pure water by mass, and a metal needle is embedded in a side wall of the sand blank, frozen at −30° C., and pulled out during initial setting of the sand blank.

Step 2: Fix the prepared frozen sand mold in an air extraction sand box that matches the sand mold in size, where the air extraction sand box has a vacuum chamber, and a vacuum pump cooperates with the air extraction hole and a filtering extraction pipe to extract air; and brush the surface of the mold cavity with a layer of thermal insulation coating, where a main material of the thermal insulation coating is aerogel, which is used to protect the mold cavity from heat damage and adhesion of the thin film.

Step 3: Cover the surface of the mold cavity of the sand mold with a thin film softened by heating. The thin film is an EVA plastic film, and a mass percentage of vinyl acetate (VA) in EVA is controlled at 14%-19%. The thin film is heated by a heater for softening at about 70° C. and then spread on the mold cavity of the sand mold.

Step 4: Cover the outer surface of the sand mold with the back film to seal the sand box. A junction of a parting surface and the EVA plastic film is bound with an adhesive tape to reduce sand inclusion defects and mold shift caused by improper operation and falling sand.

Step 5: Start the vacuum pump to provide vacuum suction force, so that the thin film tightly adheres to the sand mold, thereby completing the upper and lower boxes of the sand mold. A vacuum degree of the sand mold is controlled at 0.03-0.04 MPa in the film covering and pressure maintaining processes, and the vacuum degree is controlled at 0.05-0.06 MPa in the pouring process after the upper and lower boxes are closed.

From the above description, the embodiment of the present invention achieves the following technical effects: this method may alternatively use special sand or other heat-resistant sand instead of the thermal insulation coating, depending on the main principle that residue after film vaporization forms a transitional shell on the sand mold to maintain a shape, and molten metal quickly solidifies on the surface of the mold cavity to form a metal shell with certain strength, thereby improving the density, dimensional accuracy, and the like of a casting. Moreover, because the thin film blocks direct contact between the high-temperature molten metal and an ice crystal bonding bridge in the frozen sand mold, the strength of the sand mold is protected, and the generation of a large amount of water vapor in the pouring process is prevented. Meanwhile, the sand mold is maintained in negative pressure throughout the pouring process, and the generated water vapor can be quickly discharged, thereby accelerating filling of the molten metal and reducing defects such as air holes on the surface of the casting.

The technical means disclosed in the solution of the present invention are not limited to the technical means disclosed in the foregoing embodiment, but also include technical solutions formed by any combination of the above technical features.

What is claimed is:

1. A method for preparing a negative pressure film-covering frozen sand mold, comprising:

step 1: numerically cutting a frozen sand blank mixed with water directly in a low-temperature machining environment through a numerical model-free freeze casting technology based on a cutting shaping principle to obtain upper and lower boxes of a sand mold, wherein in step 1, the frozen sand mold is provided with an air extraction hole, wherein the air extraction hole is directly drilled out on a side wall of the sand mold by numerically controlled machining;

step 2: fixing the prepared frozen sand mold in an air extraction sand box that matches the sand mold in size, and brushing a surface of a mold cavity of the sand mold of the upper and lower boxes with a layer of thermal insulation coating;

step 3: heating a thin film at 70° C. until softened to cover the surface of the mold cavity of the sand mold brushed with the thermal insulation coating;

step 4: covering an outer surface of the sand mold with a back film to seal the sand box; and step 5: starting a vacuum pump to provide vacuum suction force, so that the thin film tightly adheres to the sand mold; covering the upper and lower boxes of the sand mold with a film under negative pressure, and then closing the upper and lower boxes to obtain an integral sand mold, wherein the thin film comprises polyester amine fibers, wherein a junction of a parting surface and the thin film is bound with an adhesive tape.

2. The method for preparing the negative pressure film-covering frozen sand mold according to claim 1, wherein a sand box for the sand mold is the air extraction sand box with a vacuum chamber, and the vacuum pump cooperates with the air extraction hole and a filtering extraction pipe to extract air.

3. The method for preparing the negative pressure film-covering frozen sand mold according to claim 1, wherein the vacuum suction force is controlled at 0.03-0.04 MPa.

4. The method for preparing the negative pressure film-covering frozen sand mold according to claim 1, wherein the thermal insulation coating is a barrier thermal insulation coating.

5. The method for preparing the negative pressure film-covering frozen sand mold according to claim 1, wherein the upper and lower boxes are closed to form the integral sand mold with a casting head, the mold cavity, and the air extraction hole; and direct pouring is performed at room temperature or low temperature while the sand mold is maintained in a negative pressure state.

6. The method for preparing the negative pressure film-covering frozen sand mold according to claim 1, wherein the thin film has a thickness of 0.1 mm.

7. The method for preparing the negative pressure film-covering frozen sand mold according to claim 1, wherein the thin film is heated by a heater for softening at 70° C., cooled, and then spread on the mold cavity of the sand mold.

* * * * *